United States Patent [19]

Aiuola et al.

[11] Patent Number: 4,774,796

[45] Date of Patent: Oct. 4, 1988

[54] APPARATUS FOR INSERTING THE LEADING END OF A PACKAGING BAND IN A CONVEYOR DEVICE

[75] Inventors: Franco Aiuola, Bologna; Renato Piccinini, Sala Bolognese, both of Italy

[73] Assignee: Azionaria Costruzioni Macchine Automatiche A.C.M.A. S.p.A., Bologna, Italy

[21] Appl. No.: 110,244

[22] Filed: Oct. 19, 1987

[30] Foreign Application Priority Data

Oct. 31, 1986 [IT] Italy ..... 3559 A/86

[51] Int. Cl.[4] ..... B65B 41/12; B65B 41/18; B65B 43/34

[52] U.S. Cl. ..... 53/168; 53/51; 53/384; 53/389; 53/570; 198/793; 242/58

[58] Field of Search ..... 53/389, 381, 384, 570, 53/168, 51; 242/58; 198/792, 793

[56] References Cited

U.S. PATENT DOCUMENTS

| | | | |
|---|---|---|---|
| 3,085,762 | 4/1963 | Subklew | 242/58 |
| 3,577,704 | 5/1971 | Lense | 53/570 X |
| 3,599,388 | 8/1971 | Feingold | 53/570 X |
| 3,618,286 | 11/1971 | Membrino | 53/570 X |
| 3,975,888 | 8/1976 | Jones | 53/570 X |
| 4,019,624 | 4/1977 | Torres | 198/792 X |
| 4,695,007 | 9/1987 | Muto et al. | 53/389 X |

*Primary Examiner*—Horace M. Culver

*Attorney, Agent, or Firm*—Guido Modiano; Albert Josif

[57] ABSTRACT

The apparatus is composed of an oscillating framework, rotatingly supporting the new and old reels, and of a closed loop flexible element provided with pegs having the same spacing as the pins of the conveyor. The flexible element is movable between a resting position at which the end of the new reel is manually hooked to the pegs and an operating position in which the flexible element follows the conveyor for a certain portion, while deflecting means transfer the end of the new reel from the pegs of the flexible element onto the pins of the conveyor.

5 Claims, 3 Drawing Sheets

APPARATUS FOR INSERTING THE LEADING END OF A PACKAGING BAND IN A CONVEYOR DEVICE

BACKGROUND OF THE INVENTION

The present invention relates to an apparatus for inserting the leading end of a packaging band in a conveyor device, for the transport and the advancement of the band, of the type composed of a conveyor belt provided with outwardly protruding pins to which the band is hung.

In the field of packaging, the use has been proposed of a device for the transport and advancement towards operating stations of a packaging band, said device consisting of a closed loop conveyor which traces an arc of a circle followed by a rectilinear portion.

Equally spaced and outwardly protruding pins are rigidly associated with the conveyor and are adapted to engage in corresponding holes located proximate to the upper edge of the packaging band. The conveyor is arranged along a horizontal plane so that the band hangs from the pins in a vertical arrangement.

SUMMARY OF THE INVENTION

The technical aim of the present invention is to provide an apparatus by means of which it is possible to insert the leading end of a new reel in a device of the above described type, in particular during the replacement of an exhausted reel.

This aim is achieved, according to the present invention, with an apparatus for inserting the leading end of a packaging band in a conveyor device having a closed loop conveyor belt, provided with pins, which traces an arc of a circle followed by a rectilinear portion, characterized in that it comprises a rotatably mounted framework provided with means for rotatingly supporting a pair of reels, an oscillating structure comprising a plurality of pegs having the same spacing as said pins of said conveyor belt and movable along a rectilinear portion, said structure having a rest position at which said pegs are at a distance from the conveyor, and the leading end of a reel can be manually hooked to said pegs, and a position adjacent to the conveyor, at which said pegs and said pins follow one another along said rectilinear portion with said pegs transversely aligned with said pins, deflecting means being furthermore provided to transfer said leading end from said pegs to said pins.

In a preferred embodiment, the band is folded double and comprises a series of adjacent pockets having mouths for the introduction of the product along the upper edge and separated from one another by transverse welding ports.

BRIEF DESCRIPTION OF THE DRAWINGS

Further characteristics and advantages of the present invention will become apparent from the following description of an embodiment, illustrated only by way of non-limitative example in the accompanying drawings, wherein.

DESCRIPTION OF THE PREFERRED EMBODIMENTS

Figure 2:
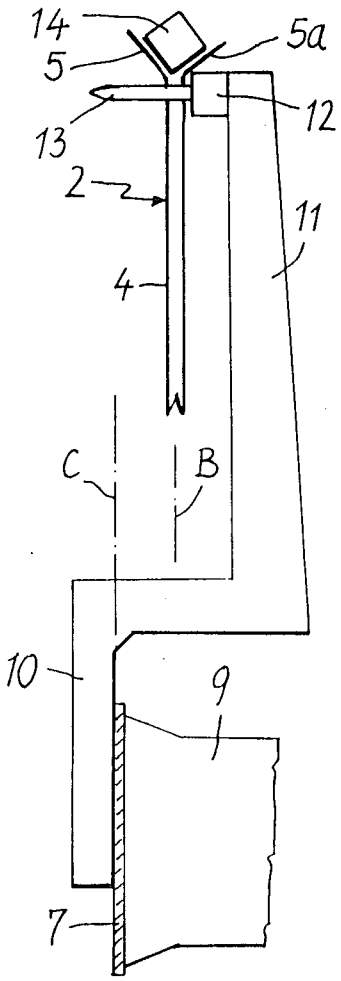
FIG. 2 is a cross section view along the plane II—II of FIG. 1.
Figure 1:
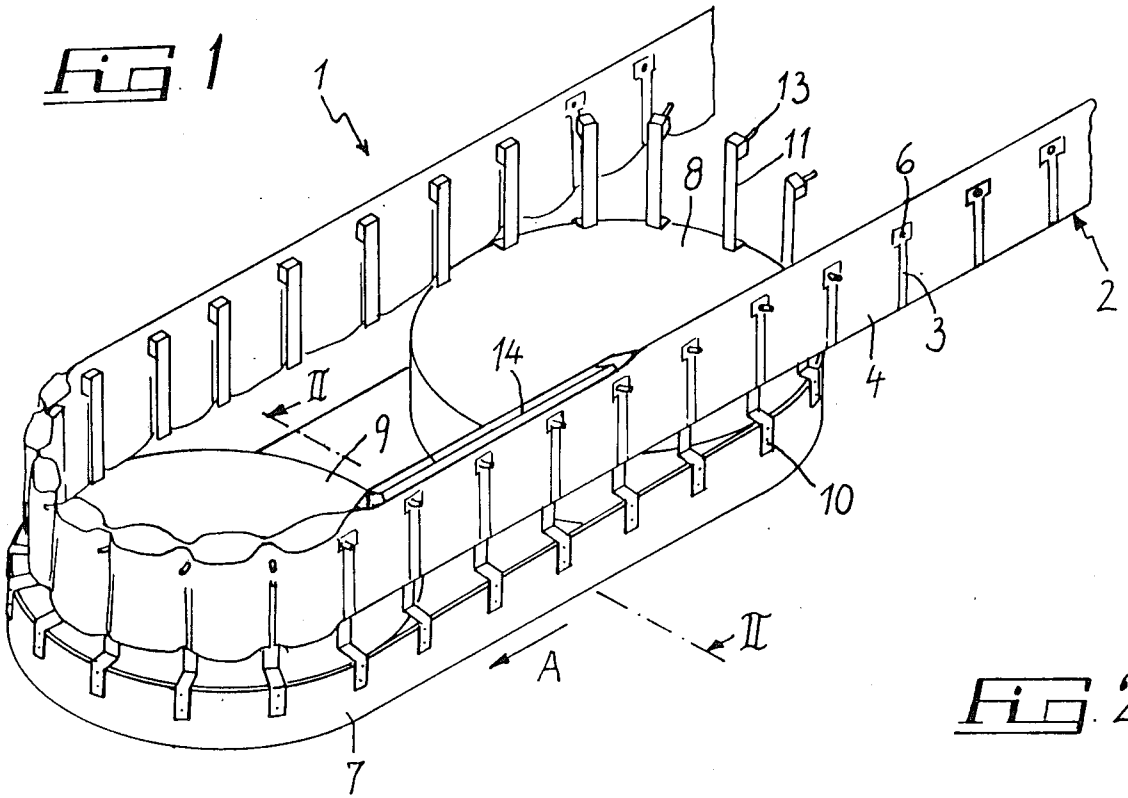
FIG. 1 is a schematic perspective view of a device for the transport and advancement of the band.

With reference to the above described figures, the reference numeral 1 generally indicates the device for the transport and feed, towards operating stations (not illustrated), of a packaging band 2 which, in this example, is composed of a band longitudinally folded in half and divided by transverse welding lines 3 into a plurality of adjacent pockets 4. The transverse welding lines 3 are shaped so that the adjacent portion of the bands are welded for a height which extends from the bottom of the pockets to a preset distance from the edge of the pockets, so as to leave the two flaps 5,5*a* free (see FIG. 2). The upper end of the transverse welding lines is provided with a wider portion in which an eyelet 6, obtained by punching, is provided.

The device 1 comprises a conveyor constituted by a closed loop belt 7, for example made of a steel strap, wound in a loop on a pair of pulleys 8, 9 arranged on a horizontal plane. Small inwardly facing L-shaped elements are rigidly associated with the closed loop belt 7, and are provided with respective small columns 11 rising vertically and having small blocks 12 at their top to which outwardly projecting pins 13 are rigidly associated and adapted to engage in the eyelets 6 so as to act as coupling elements for the band 2. By virtue of the eyelets 6, the band 2, hanging from the pins 13, is taken towards the operating stations arranged downstream with respect to the direction of advancement A, where the filling and closure of the pockets, as well as the separation thereof, will be peformed. Said stations are not illustrated in the drawings.

Figure 4:
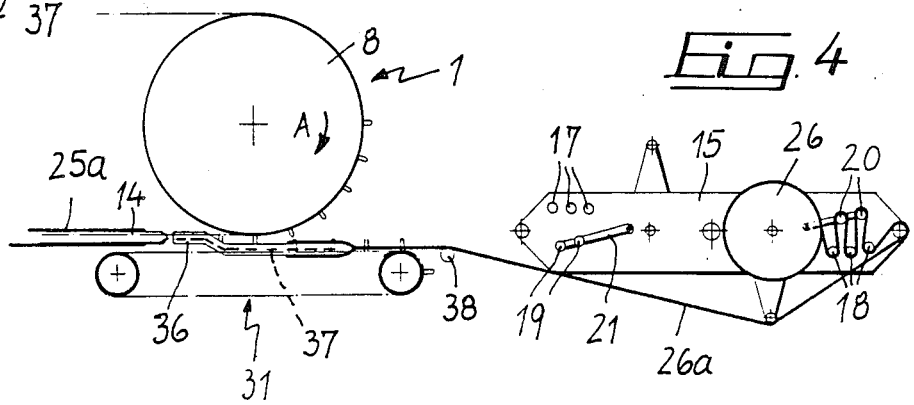

Before following the circular trajectory of the pulley 9, the upper flaps 5, 5*a* of the band are opened in the shape of a V by a folder 14 (see FIG. 4) constituted by a beam having a square cross section. In the illustrated example, the plane of arrangement B of the band 2 along the path which comprises the two parallel portions of the closed loop belt 7 and the semicircular portion of the wheel 9 is slightly moved inwards with respect to the plane C of the closed loop belt. In this manner, when the pockets 4 follow the circular path imparted by the wheel 9, the pins 13 move closer to each other widening the mouth of the pockets and thus allowing the introduction of the product.

Figure 7:
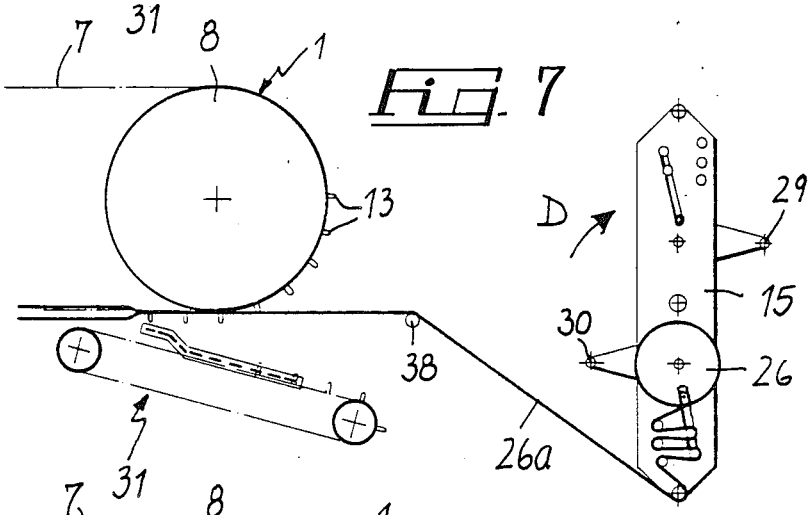

The apparatus which allows the automatic insertion of a band 2 in the device according to what has been described above comprises an elongated framework 15 which is rotatable about the fulcrum 16 in a direction D (FIG. 7), and on a horizontal plane. At the opposite ends of the framework 15, two sets of fixed rollers 17, 18 are rotatably mounted, and further free rollers 19, 20 mounted on respective oscillating rods 21, 22 pivoted on the framework 15, cooperate therewith. The rods 21, 22 are subject to elastic means, not illustrated in the drawings, which tend to space apart the rollers 19, 20 from the fixed rollers 17, 18. The rotation pivots 23, 24 for two respective reels 25, 26 of packaging band of the type previously indicated by 2 are arranged on opposite sides with respect to the fulcrum 16. For the sake of clarity in explanation, the band originating from the reel 25 is indicated by 25*a* and the one originating from the reel 26 with 26*a*.

Two ledges 27, 28 furthermore project from opposite sides of the framework 15 at the reels 25, 26, and two rollers 29, 30 are rotatably mounted thereon.

The rollers 17, 19 and 18, 20 act as a compensation magazine during the reel substitutions. The apparatus also comprises an oscillating structure 31, arranged to the side of the wheel 8 and composed of a flexible element 32 closed in a loop on two pulleys 33, 34 so as to have two parallel rectilinear portions. The oscillating structure 32 is movable between a position inclined with respect to the device 1 in which it defines a certain angle with the rectilinear portion of the closed loop belt 7 and a position in which the rectilinear portions of the belt 7 and of the flexible element 32 are adjacent and parallel.

The flexible element 32 is rotated with a speed equal to that of the belt 7, but opposite in direction, so that the adjacent portions travel together in the same direction A.

A group of pegs 35 is rigidly associated with the flexible element and protrude outwards having a mutual spacing which is equal to that of the pins 13. Moreover, the pegs 35 are arranged at the same height as the pins so that, along the rectilinear portions in which they follow one another, the pegs 35 are transversely aligned with the pins 13 with the ends in mutual contact.

A stationary folder 36 is rigidly associated with the structure 31 above the pegs 35 and on the side facing towards the device 1, and has a portion aligned with the rectilinear portion of the flexible element 32 which continues with an elbow-shaped portion aligned with the folder 14 when the structure 31 is adjacent to the device 1. The folder 36 has the same function as that of the folder 14, namely, to keep open the flaps of the band of the new reel as will become apparent hereinafter. Below the pegs 35, and arranged on the same plane as that of the folder 36, a deflector 37 is arranged stationary and is composed of a wall having the function of moving the band away from the pegs 35 during the insertion into the device 1. The described apparatus is completed by a roller 38 which is movable in front of the structure 31.

Figure 3:
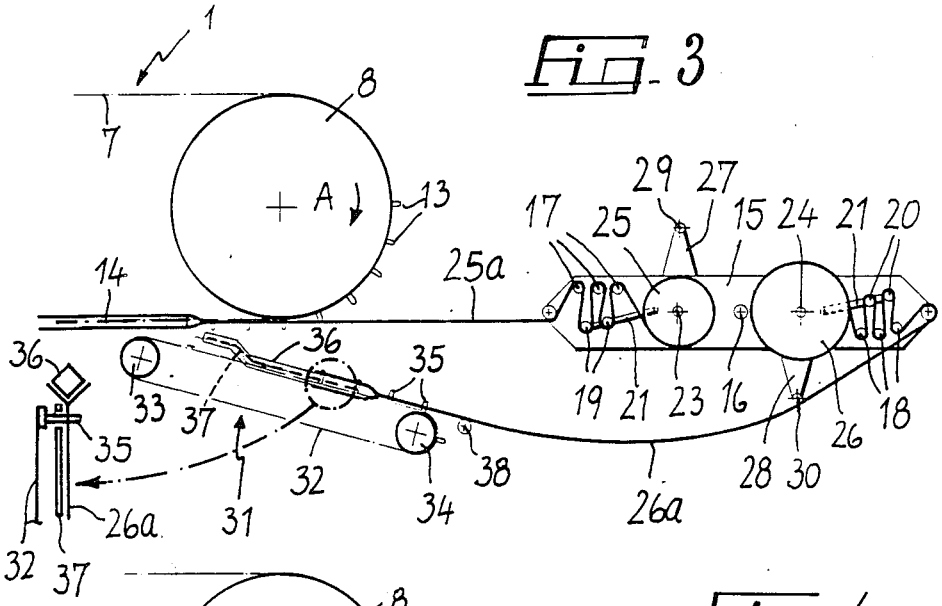
FIGS. 3–8 are schematic top views of the apparatus according to the invention in various operating positions.

The operation of the described apparatus is as follows. Suppose the apparatus is in the operating condition illustrated in FIG. 3, in which the band 25*a* is fed into the device 1. While the unreeling of the reel 25 continues, the operator arranges a new reel 26 on the framework 15. The end of the band 26*a*, after being placed around the rollers 18 and 20, is hooked to the pegs 35 with its flaps opened out by the folder 36.

Figure 5:
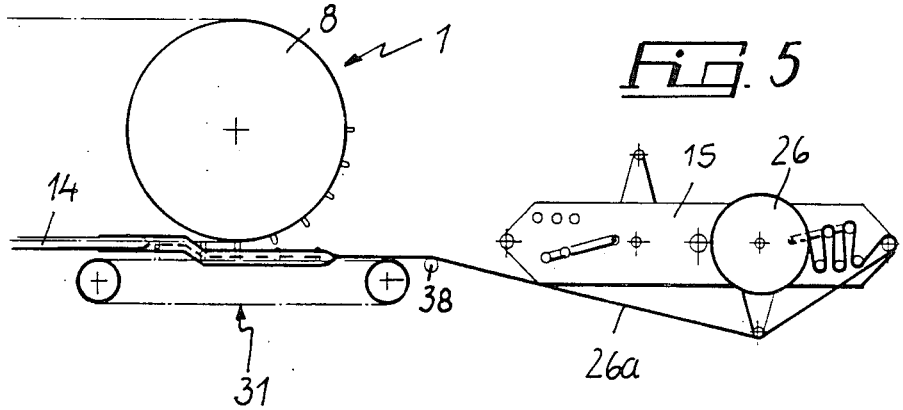

When the reel 25 is exhausted (FIG. 4), the structure 31 is placed close to the device 1 so as to align the folders 14 and 36. By operating the flexible element 32 synchronously with the belt 7, the deflector 37 determines the movement of the band from the pegs 35 to the pins 13 (FIG. 5) until, when the pegs 35 have reached the return point, the band 2 is completely inserted on the pegs 13.

Figure 6:
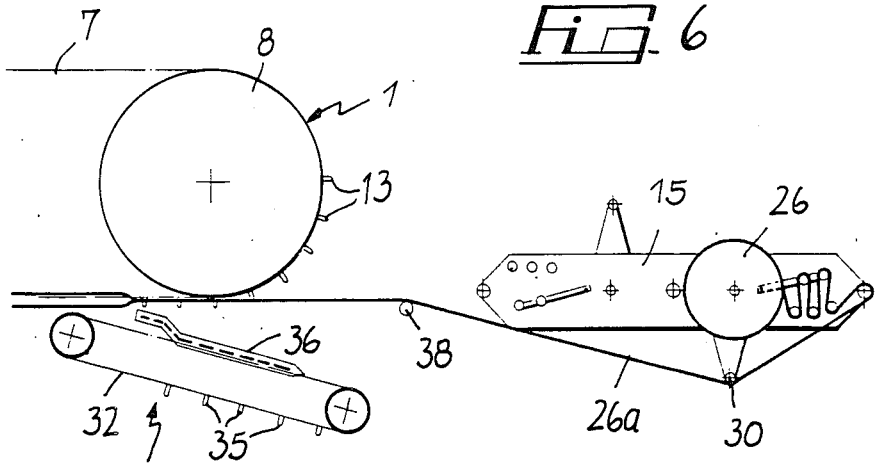
Figure 8:
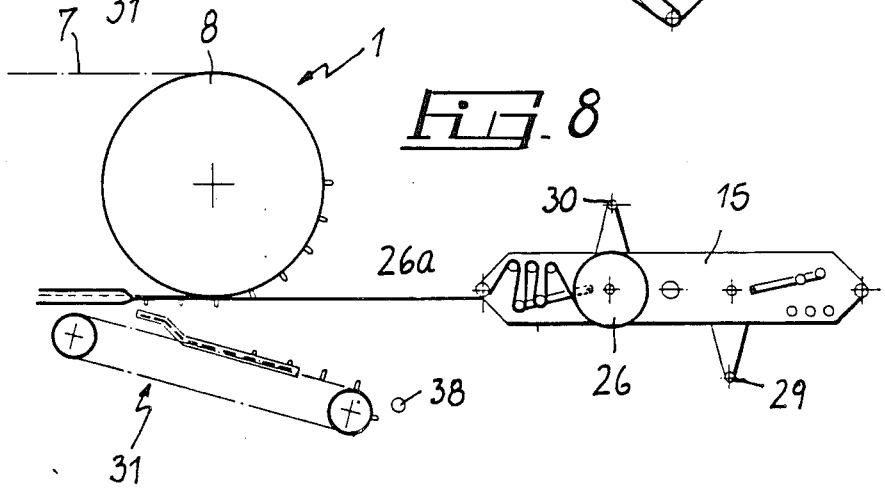

At this point the oscillating structure 31 is moved away again (FIG. 6) and the framework 15 is rotated (FIG. 7) to return it to the position which allows the mounting of a new reel (FIG. 8).

It should be noted that the reel 38 contributes to keep the band 2 perfectly aligned with the device 1 and can be removed during the operations of insertion of the new band on the pegs 35.

As can be seen, the invention fully achieves the intended aims. In particular it is possible to perform the replacement of the exhausted reel without having to stop the device 1.

We claim:

1. Apparatus for inserting the leading end of a packaging band in a conveyor device having a closed loop conveyor belt, provided with pins, which traces an arc of a circle followed by a rectilinear portion, comprising a rotatably mounted framework provided with means for rotatingly supporting a pair of reels, an oscillating structure comprising a plurality of pegs having the same spacing as said pins of said conveyor belt and movable along a rectilinear portion, said structure having a rest position at which said pegs are at a distance from the conveyor, and the leading end of a band can be manually hooked to said pegs, and a position adjacent to the conveyor, at which said pegs and said pins follow one another along said rectilinear portion with said pegs transversely aligned with said pins, deflecting means being furthermore provided to transfer said leading end from said pegs to said pins.

2. Apparatus according to claim 1, wherein said structure comprises a closed loop flexible element provided with a number of pegs having the same spacing as said pins, said flexible element having a rectilinear portion which, in said position of said structure adjacent to said conveyor, is parallel to said rectilinear portion of said conveyor.

3. Apparatus according to claim 2, wherein said deflecting means comprise a wall having a portion aligned with said rectilinear portion of said flexible element and an elbow-shaped portion which, in said position of said structure adjacent to said conveyor, is aligned with said rectilinear portion of said conveyor.

4. Apparatus according to claim 1, wherein said framework comprises a plurality of fixed rollers cooperating with a plurality of free oscillating rollers to form a compensation magazine.

5. Apparatus, according to claim 1, wherein said band has adjacent pockets having upwardly open mouths defined by two adjacent flaps, said structure comprising a folder, arranged above said deflecting means and aligned therewith, adapted to keep said flaps apart from each other.

* * * * *